US009131290B2

(12) United States Patent
Kishi et al.

(10) Patent No.: US 9,131,290 B2
(45) Date of Patent: Sep. 8, 2015

(54) AUDIO CODING DEVICE, AUDIO CODING METHOD, AND COMPUTER-READABLE RECORDING MEDIUM STORING AUDIO CODING COMPUTER PROGRAM

(75) Inventors: Yohei Kishi, Kawasaki (JP); Miyuki Shirakawa, Fukuoka (JP); Masanao Suzuki, Kawasaki (JP); Yoshiteru Tsuchinaga, Fukuoka (JP); Shunsuke Takeuchi, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 856 days.

(21) Appl. No.: 13/362,317

(22) Filed: Jan. 31, 2012

(65) Prior Publication Data

US 2012/0224703 A1 Sep. 6, 2012

(30) Foreign Application Priority Data

Mar. 2, 2011 (JP) ..... 2011-045171

(51) Int. Cl.
*G10L 19/025* (2013.01)
*H04R 3/00* (2006.01)

(52) U.S. Cl.
CPC ..... *H04R 3/00* (2013.01); *G10L 19/025* (2013.01)

(58) Field of Classification Search
CPC ..... G10L 19/025
USPC ..... 704/500–504
See application file for complete search history.

(56) References Cited

U.S. PATENT DOCUMENTS

| | | | | |
|---|---|---|---|---|
| 7,020,615 | B2 * | 3/2006 | Vafin et al. | 704/500 |
| 2006/0136229 | A1 * | 6/2006 | Kjoerling et al. | 704/501 |
| 2006/0256971 | A1 * | 11/2006 | Chong et al. | 381/23 |
| 2007/0016405 | A1 * | 1/2007 | Mehrotra et al. | 704/203 |
| 2008/0120116 | A1 * | 5/2008 | Schnell et al. | 704/500 |
| 2008/0219344 | A1 * | 9/2008 | Suzuki et al. | 375/240.01 |
| 2009/0228285 | A1 * | 9/2009 | Schnell et al. | 704/500 |
| 2011/0202358 | A1 * | 8/2011 | Neuendorf et al. | 704/503 |
| 2012/0051549 | A1 * | 3/2012 | Nagel et al. | 381/56 |
| 2012/0224703 | A1 * | 9/2012 | Kishi et al. | 381/23 |

FOREIGN PATENT DOCUMENTS

| | | |
|---|---|---|
| JP | 2003-529787 | 10/2003 |
| JP | 2006-3580 | 1/2006 |
| JP | 2008-224902 | 9/2008 |
| WO | WO 01/26095 | 4/2001 |

* cited by examiner

*Primary Examiner* — Samuel G Neway
(74) *Attorney, Agent, or Firm* — Staas & Halsey LLP

(57) ABSTRACT

An audio coding device includes a time frequency transform unit that, with respect to each of a plurality of channels included in an audio signal, generates a time frequency signal indicating frequency components at each time by performing a time frequency transform on a signal of the channel; a transient detection unit that detects a transient with respect to each of the plurality of channels so as to obtain a transient detection time; a transient time correction unit that, when a difference in transient detection times between an early detection channel in which the transient detection time is earliest and a late detection channel that is a channel other than the early detection channel among the plurality of channels is within a range in which the transient; a grid determination unit that, with respect to each of the plurality of channels, and a coding unit that codes.

18 Claims, 11 Drawing Sheets

AUDIO CODING DEVICE, AUDIO CODING METHOD, AND COMPUTER-READABLE RECORDING MEDIUM STORING AUDIO CODING COMPUTER PROGRAM

CROSS-REFERENCE TO RELATED APPLICATION

This application is based upon and claims the benefit of priority of the prior Japanese Patent Application No. 2011-45171, filed on Mar. 2, 2011, the entire contents of which are incorporated herein by reference.

FIELD

The embodiments disclosed herein are related to, for example, an audio coding device, an audio coding method, and a computer-readable recording medium storing an audio coding computer program.

BACKGROUND

Hitherto, audio signal coding methods for compressing the amount of data of an audio signal have been developed. As one of such coding methods, High-Efficiency Advanced Audio Coding (HE-AAC) is known. This coding method has been standardized as MPEG-2 HE-AAC and MPEG-4 HE-AAC by the Moving Picture Experts Group (MPEG). In HE-AAC, the low frequency band (low frequency components) of an audio signal is coded in accordance with an Advanced Audio Coding (AAC) method, whereas the high frequency band (high-frequency components) of an audio signal is coded in accordance with a Spectral Band Replication (SBR) method. In the SBR method, each frame of an audio signal is divided into a plurality of time-frequency domains, and auxiliary information or the like for reproducing high-frequency components by reproducing corresponding low frequency components on the basis of the signal power within each time-frequency domain are calculated as SBR data. Then, an SBR parameter is coded. This time-frequency domain is called a grid.

In the SBR method, if the time length of a grid is too long with respect to the temporal change of an audio signal, the electric power of the audio signal is averaged in the grid, and thereby the information indicating the temporal change is lost. As a result, the reproduction sound quality of the coded audio signal deteriorates. There is a case where, in particular, as a result of sound in a certain time period being affected by sound later than that sound, sound that differs from the original sound is produced. Such a phenomenon is called a pre-echo. In Japanese National Publication of International Patent Application No. 2003-529787, a technology is disclosed in which a highly transient sound, such as attack sound, is detected with respect to each channel of an audio signal, and a grid is set so that the time resolution increases with respect to the highly transient sound. Such a transient portion of sound is called a transient.

Furthermore, in Japanese Laid-open Patent Publication No. 2006-3580, a technology has been disclosed in which when it is determined that the degree of similarity of a plurality of channels of an audio signal is high, a grouping of frequency data such that an audio signal is frequency-converted in the time direction or in the frequency direction is performed in common with respect to a plurality of channels.

SUMMARY

According to an aspect of the embodiments, an audio coding device includes a time frequency transform unit that, with respect to each of a plurality of channels included in an audio signal, generates a time frequency signal indicating frequency components at each time by performing a time frequency transform on a signal of the channel; a transient detection unit that detects a transient with respect to each of the plurality of channels so as to obtain a transient detection time; a transient time correction unit that, when a difference in transient detection times between an early detection channel in which the transient detection time is earliest and a late detection channel that is a channel other than the early detection channel among the plurality of channels is within a range in which the transient may be regarded as a transient caused by the same sound, makes a correction so that the transient detection time of the late detection channel coincides with the transient detection time of the early detection channel; a grid determination unit that, with respect to each of the plurality of channels, sets a grid for a non-transient sound in a section in which the transient has not been detected, and sets a grid for a transient sound having a length of time shorter than that of the grid for a non-transient sound in a section in which the transient has been detected; and a coding unit that codes the audio signal for each grid for a transient sound or for each grid for a non-transient sound.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which.

DESCRIPTION OF EMBODIMENTS

A description will be given below of an audio coding device according to an embodiment. First, with reference to FIG. 1, a description will be given of causes in which, in the related art, detection times of transients that originally occur at the same time in all the channels differ for each channel.

Figure 1A:
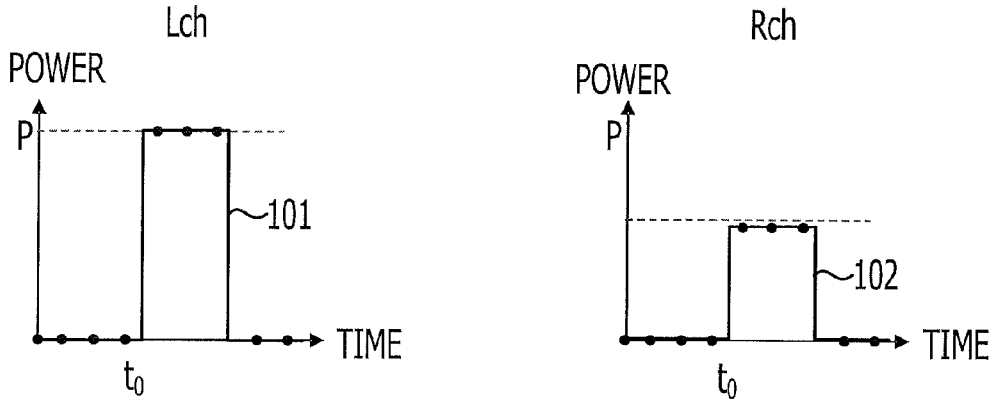
FIG. 1A illustrates an example of a temporal change of the powers of a left side channel and a right side channel, in which a transient is contained.
Figure 1B:
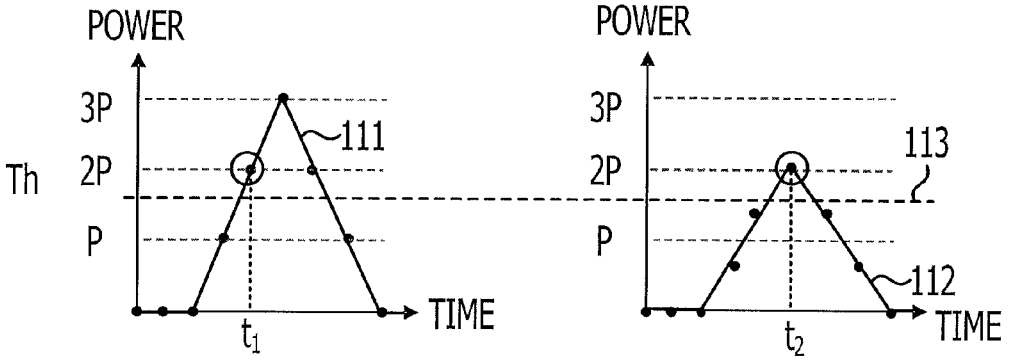
FIG. 1B illustrates a moving accumulated value of the powers of the channels illustrated in FIG. 1A.
Figure 1C:
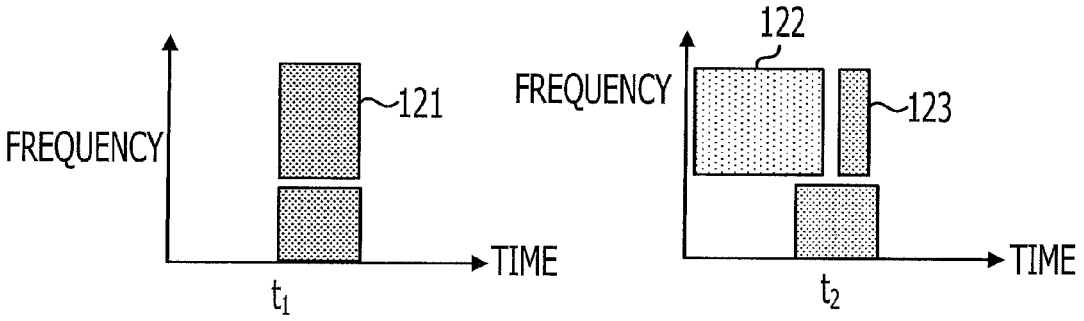
FIG. 1C illustrates an example of a grid, which is set by the related art, with respect to an audio signal of each channel illustrated in FIG. 1A.

FIG. 1A illustrates an example of a temporal change of the powers of the channels on the left side and on the right side of a stereo audio signal, in which a transient is contained. FIG. 1B illustrates a moving accumulated value of the powers of the channels illustrated in FIG. 1A. FIG. 1C illustrates an example of a grid, which is set by the related art, with respect to an audio signal of each channel illustrated in FIG. 1A.

In FIGS. 1A and 1B, the horizontal axis represents time, and the vertical axis represents power. In FIG. 1A, a graph 101 illustrates a temporal change of the power of a signal of the left side channel, and a graph 102 illustrates a temporal change of the power of a signal of the right side channel. Each dot in the graph indicates a sampling point. As illustrated in FIG. 1A, a transient occurs at time $t_0$, and power increases suddenly with respect to both the left side and right side channels. However, the power after the transient of the left side channel occurs is larger than the power after the transient of the right side channel occurs. Such a phenomenon occurs when, for example, the sound source is closer to a microphone corresponding to one of channels than the microphone corresponding to the other channel.

In FIG. 1B, a graph 111 illustrates a temporal change of a moving accumulated value of the powers of the signal of the left side channel, and a graph 112 illustrates a temporal change of a moving accumulated value of the powers of the signal of the right side channel. In this example, the moving accumulated value is the accumulated value of the power of a signal of each sampling point in a section that is set along the time axis including three consecutive sampling points. In the manner described above, in this example, immediately after a transient occurs, the power of the signal of the channel on the left side is larger than the power of the signal of the channel on the right side. For this reason, as illustrated in the graphs 111 and 112, the moving accumulated value of the left side channel increases suddenly more than the moving accumulated value of the right side channel.

The audio coding device of the related art compares, for example, the moving accumulated value of the power of the signal of each channel with a certain threshold value, and determines that a transient has occurred at a time at which the moving accumulated value becomes greater than the certain threshold value. For example, when a threshold value Th is a value indicated by a dotted line 113 in FIG. 1B, time $t_1$ at which the moving accumulated value of the left side channel becomes greater than the threshold value Th is earlier than time $t_2$ at which the moving accumulated value of the right side channel becomes greater than the threshold value Th. For this reason, the audio coding device of the related art determines that the time $t_1$ is a time at which the transient has occurred with respect to the left side channel, and determines that the time $t_2$ is a time at which the transient has occurred with respect to the right side channel.

In FIG. 1C, the horizontal axis represents time, and the vertical axis represents a frequency. Each block indicates a respectively set grid. In the left side channel, the time $t_1$ close to the actual transient occurrence time is set as the start time of a grid 121 corresponding to the transient. For this reason, on the left side channel, a pre-echo hardly occurs. On the other hand, on the right side channel, different grids 122 and 123 are set to a signal before time $t_2$ and a signal at and after time $t_2$, respectively, with time $t_2$ being a boundary. However, since the actual occurrence time of the transient is earlier than time $t_2$, in the grid 122, the powers of the signals before and after the transient occurs are averaged. As a result, on the right side channel, a pre-echo occurs in a period corresponding to the grid 122.

Accordingly, the audio coding device disclosed in the present specification determines whether or not the transient detected in each channel is caused from the same sound on the basis of the difference between transient detection times among the plurality of channels and the power of the signal at, the detection time of the transient. When the transient detected in each channel has been caused from the same sound, the audio coding device unifies the start times of the grids for SBR coding with respect to all the channels to the earliest time among the detection times of the transients of the plurality of channels.

In the present embodiment, an audio signal to be coded is a stereo audio signal having a channel on the left side and a channel on the right side.

Figure 2:
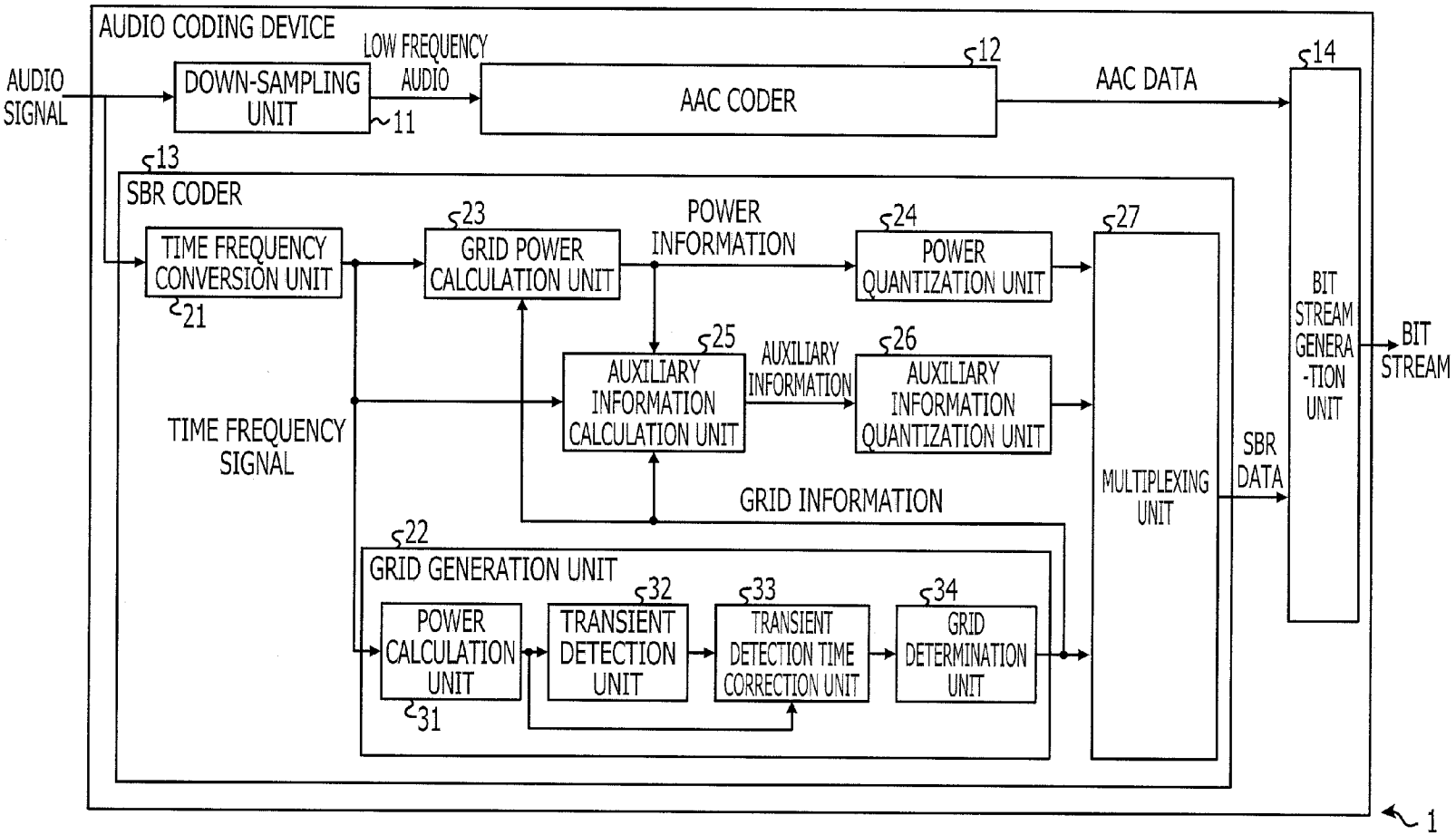
FIG. 2 is a schematic block diagram of an audio coding device according to an embodiment.

FIG. 2 is a schematic block diagram of an audio coding device according to an embodiment. As illustrated in FIG. 2, an audio coding device 1 includes a down-sampling unit 11, an AAC coder 12, an SBR coder 13, and a bit stream generation unit 14.

These units included in the audio coding device 1 are formed as individually separate circuits. Alternatively, these units included in the audio coding device 1 may be mounted, on the audio coding device 1, as one integrated circuit in which circuits corresponding to the units are integrated. In addition, these units included in the audio coding device 1 may be function modules which are implemented by a computer program that is executed on a processor included in the audio coding device 1.

The down-sampling unit 11 obtains the low frequency components of each channel of the input audio signal, which is coded by the AAC coder 12. The frequency of the upper limit of the low frequency components is set to, for example, ½ of the highest frequency of the input audio signal. The down-sampling unit 11 performs filtering on a signal of the time domain of each channel by using a low-pass filter. Such a low-pass filter may be made to be a finite or infinite impulse response digital filter. The down-sampling unit 11 filters a signal of the time domain of each channel by using, for example, an infinite impulse response filter of the following equation, which is indicated in the HE-AAC encoder standard (TS26.410) disclosed by the standardization project 3GPP.

$$H(z) = \frac{\sum_{k=0}^{13} a_k z^{-k}}{1 - \sum_{k=1}^{13} b_k z^{-k}} \tag{1}$$

where $a_k$ and $b_k$ (k=1, 2, . . . , 13) are filter coefficients. For the values of $a_k$ and $b_k$, for example, values indicated in TS26.410 are used. $z^{-k}$ is a signal that is input to this filter at a k-th time.

Furthermore, the down-sampling unit 11 may perform a time frequency transform on the signal of each channel, for example, for each frame, and apply a low-pass filter to the frequency signal obtained thereby, thereby extracting low frequency components of the signal of each channel. In this case, the down-sampling unit 11 may use, as a time-frequency transform, for example, a high-speed Fourier transform, a discrete cosine transform, or a modified discrete cosine transform. The down-sampling unit 11 outputs the extracted low frequency components of the signal of each channel to the AAC coder 12.

The AAC coder 12 codes the low frequency components of the signal of each channel, which are received from the down-sampling unit 11, in accordance with the AAC coding method. The AAC coder 12 may use the technology disclosed in, for example, Japanese Laid-open Patent Publication No. 2007-183528. Specifically, the AAC coder 12 calculates a perceptual entropy (PE) value. The PE value has characteristics that become a large value with respect to sound whose signal level changes in a short time, such as attack sound like sound emitted by a percussion instrument. Accordingly, in the AAC coder 12, a window that is set along the time axis is shortened with respect to a frame whose PE value becomes comparatively large, and the window is lengthened with respect to a frame whose PE value becomes comparatively small. For example, the short window contains 256 samples, and the long window contains 2048 samples. The AAC coder 12 performs a modified discrete cosine transform (MDCT) on low frequency components of the signal of each channel by using a window having the determined length, thereby converting the low frequency components of the signal of each channel into a set of MDCT coefficients. The AAC coder 12 quantizes the set of MDCT coefficients at a certain quantization width, and codes the set of quantized MDCT coefficients and the quantization coefficient used to the determine the quantization width in accordance with a variable length coding method, such as arithmetic coding or Huffman coding.

The AAC coder 12 outputs the set of variable-length-coded MDCT coefficients and the quantization coefficient to the bit stream generation unit 14.

The SBR coder 13 codes high-frequency components of the signal for each channel in accordance with a Spectral Band Replication (SBR) coding method. The high-frequency components are components within the signal of each channel, from which low frequency components that are coded by the AAC coder 12 are excluded.

The SBR coder 13 includes a time frequency transform unit 21, a grid generation unit 22, a grid power calculation unit 23, a power quantization unit 24, an auxiliary information calculation unit 25, an auxiliary information quantization unit 26, and a multiplexing unit 27.

The time frequency transform unit 21 converts the signal of the time domain of each channel of an audio signal, which is input to the audio coding device 1, into a time frequency signal.

In the present embodiment, the time frequency transform unit 21 uses a quadrature mirror filter (QMF) filter bank in order to obtain a time frequency signal. The QMF filter bank is represented as in the following equation $$QMF(k, n) = \exp\left[j\frac{\pi}{128}(k + 0.5(2\pi + 1\right], \quad 0 \le k < 64, \quad 0 \le n < 128 \tag{2}$$

where k is a variable indicating the frequency band, and in this example, denotes the k-th frequency band when the entire frequency band is equally divided into 64 portions. n denotes the time sequence of 128 sampling points that are input to the filter bank.

The time frequency transform unit 21 may calculate the time frequency signal of each channel by performing another time frequency transform process, such as a wavelet transform or a high-speed Fourier transform, for each certain section.

Each time the time frequency transform unit 21 calculates the time frequency signal of each channel, the time frequency transform unit 21 outputs the time frequency signal to the grid generation unit 22, the grid power calculation unit 23, and the auxiliary information calculation unit 25.

The grid generation unit 22 sets a grid for each channel. For this purpose, the grid generation unit 22 includes a power calculation unit 31, a transient detection unit 32, a transient time correction unit 33, and a grid determination unit 34.

The power calculation unit 31 calculates power at each time with respect to each channel, that is, power for each sampling point in the time axis of the time frequency signal. For example, the power calculation unit 31 calculates power in accordance with the following equation.

$$P_L(n) = \sum_{k=0}^{63} |L(k, n)|^2 \qquad P_R(n) = \sum_{k=0}^{63} |R(k, n)|^2 \tag{3}$$

where L(k, n) denotes the time frequency signal of the n-th sampling point in the frequency band k of the left side channel, and R(k, n) denotes the time frequency signal of the n-th sampling point in the frequency band k of the right side channel. $P_L(n)$ and $P_R(n)$ denote the powers of the n-th sampling points of the left side channel and the right side channel, respectively.

The power calculation unit 31 outputs power $P_L(n)$ and $P_R(n)$ for each sampling point with respect to each channel to the transient detection unit 32 and the transient time correction unit 33.

The transient detection unit 32 detects a transient for each channel. For this purpose, the transient detection unit 32 calculates, for each channel, the moving accumulated value of the power in the section containing a plurality of sampling points that are consecutive along the time axis. For example, the transient detection unit 32 sets the total value of the powers of three sampling points that are consecutive with respect to the left side channel and the right side channel as a moving accumulated value.

The transient detection unit 32 compares the moving accumulated value with the detection threshold value Th for each channel. When the moving accumulated value of the current sampling point is greater than the detection threshold value Th and when the moving accumulated value in the immediately previous sampling point is smaller than or equal to the detection threshold value Th, the transient detection unit 32 detects the current sampling point as a transient. The detection threshold value Th is determined in advance on the basis of, for example, the difference of the powers before and after the transient in an experimental manner. When the difference between the powers before and after the transient is −30 dBov and when the moving accumulated value is the total value of the powers of consecutive three sampling points, the detection threshold value Th may be set at −10 dBov.

By using the moving accumulated value so as to detect a transient, it is possible for the transient detection unit 32 to suppress a specific sampling point from being erroneously detected as a transient even if power becomes very large at such a sampling point as a result of noise being superposed onto an audio signal.

Figure 3:
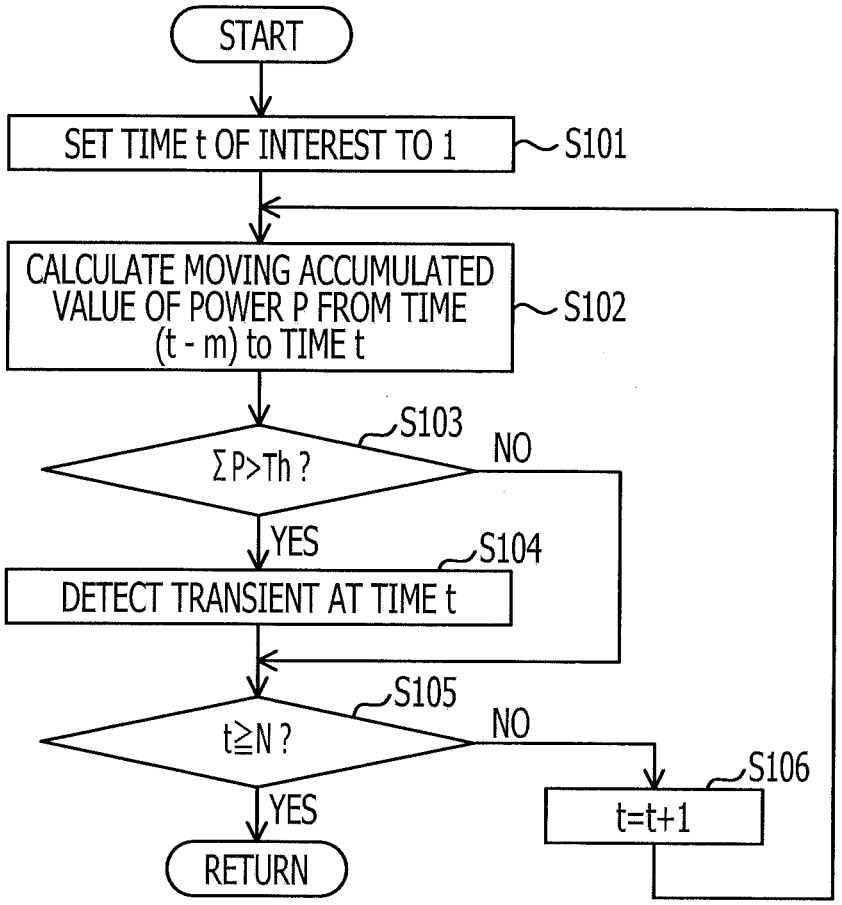
FIG. 3 is an operation flowchart of a transient detection process.

FIG. 3 is an operation flowchart of a transient detection process performed by the transient detection unit 32. The transient detection unit 32 performs processing illustrated in this flowchart for each channel and for each frame.

The transient detection unit 32 sets time t of interest to first time '1' in the frame (operation S101). Next, the transient detection unit 32 calculates the moving accumulated value ΣP from time (t−m) to time t (operation S102). m denotes the section in which the moving accumulated value is calculated. For example, when the moving accumulated value ΣP is calculated on the basis of the three sampling points that are consecutive in the time direction, m=2. Furthermore, when (t−j) (j=1, 2, . . . , m) is smaller than or equal to 0, the power of the time (N−j) of the previous frame (N is the total number of sampling points in the time axis, which are contained in one frame) is used to calculate the moving accumulated value ΣP.

The transient detection unit 32 determines whether or not the moving accumulated value ΣP is greater than the detection threshold value Th (operation S103). When the moving accumulated value ΣP is greater than the detection threshold value Th (operation S103—Yes), the transient detection unit 32 detects a transient (operation S104). Then, the transient detection unit 32 notifies the transient time correction unit 33 that time t is a transient detection time.

On the other hand, when the moving accumulated value ΣP is smaller than or equal to the detection threshold value Th (operation S103—No), or after operation S104, the transient detection unit 32 determines whether or not the total number of sampling points in one frame in the time axis in which time t of interest is contained is greater than or equal to N (operation S105). When t is smaller than N (operation S105—No), the transient detection unit 32 increments time t by 1 (operation S106). Then, the transient detection unit 32 repeats processing at and subsequent to operation S101. On the other hand, when t is greater than or equal to N (operation S105—Yes), the transient detection unit 32 ends the transient detection process.

The transient detection unit 32 may calculate the moving average value of powers in place of the moving accumulated value of powers. In this case, the detection threshold value may be made to be a value such that the detection threshold value for the moving accumulated value is divided by the number of sampling points contained in the section used to calculate one moving average value. Both the moving accumulated value of the powers and the moving average value of the powers are examples of statistical values of powers.

Each time a transient is detected with respect to each channel, the transient detection unit 32 notifies the transient time correction unit 33 of the detection time (that is, the number of the sampling point detected as a transient) of the transient.

There is a case where, in the manner described above, in spite of the fact that a transient has occurred in each channel, for example, attack sound emitted from one sound source, the transient being caused by the same sound, the detection times of transients of each channel differ. In such a case, there is a risk of a pre-echo occurring in a channel in which the detection time of the transient is late. Accordingly, the transient time correction unit 33 determines whether or not the difference between the transient detection times among the channels is within a range in which the transient may be regarded as a transient caused by the same sound. When the difference between the detection times is within a range in which the transient may be regarded as a transient caused by the same sound, the transient time correction unit 33 corrects the detection time with respect to the channel in which the detection time of the transient is late, and causes the detection time to coincide with the detection time of the transient of the other channel. For this purpose, the transient time correction unit 33 temporarily stores, in an incorporated memory, the transient detection time of each channel, which has been notified from the transient detection unit 32, and the power at each time (that is, at each sampling point of the time axis), which has been received from the power calculation unit 31.

Figure 4A:
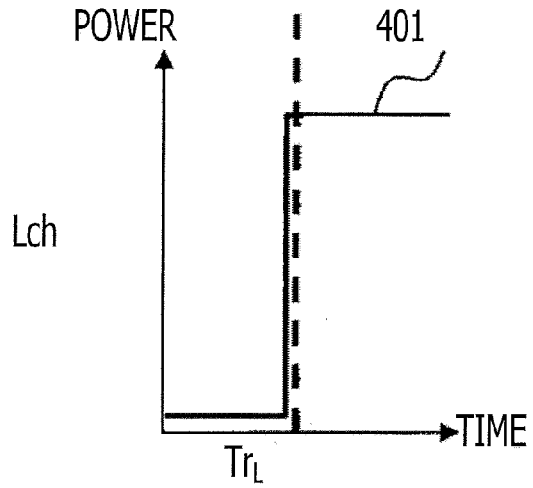
FIG. 4A illustrates a temporal change in powers of a left side channel and a right side channel when the detection time of each channel differs with respect to a transient caused by the same sound.
Figure 4B:
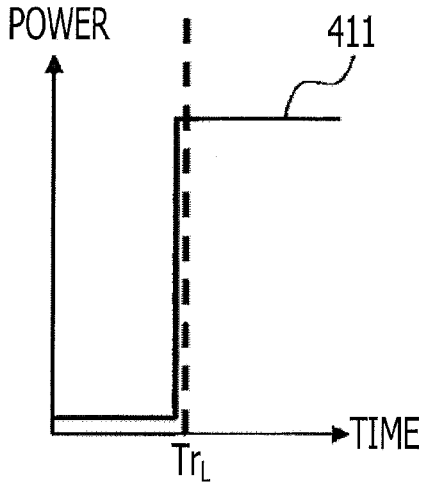
FIG. 4B illustrates a temporal change in powers of a left side channel and a right side channel when a transient of the right side channel and a transient of the left side channel are caused by different sounds.
Figure 4B:
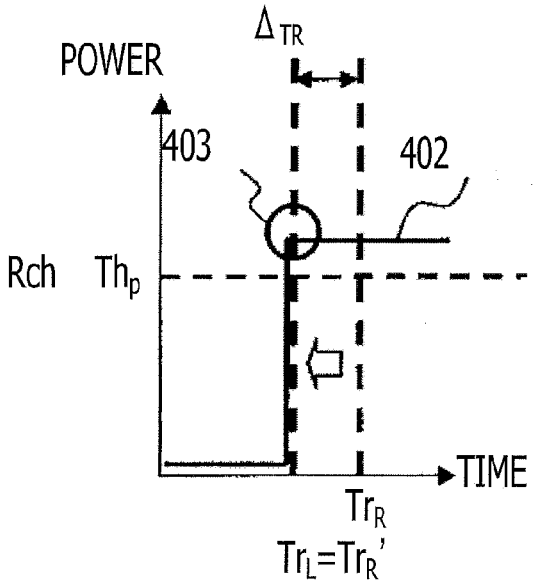
Figure 4B:
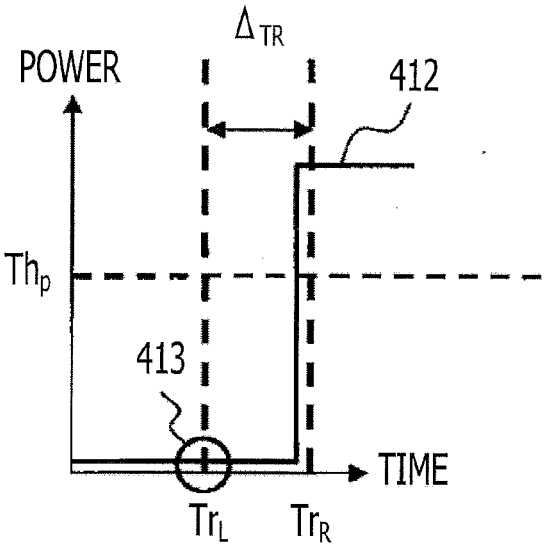

Referring to FIGS. 4A and 4B, an overview of the process performed by the transient time correction unit 33 will be described. As an example, it is assumed that the transient detection time of the right side channel is later than the transient detection time of the left side channel. FIG. 4A illustrates the temporal change in the powers of a left side channel and a right side channel when the detection time of each channel differs with respect to a transient caused by the same sound. On the other hand, FIG. 4B illustrates the temporal change in the powers of a left side channel and a right side channel when a transient of the right side channel and a transient of the left side channel are caused by different sounds.

In FIGS. 4A and 4B, the horizontal axis represents time, and the vertical axis represents power. A graph 401 in FIG. 4A illustrates the temporal change of the power of a left side channel, and a graph 402 illustrates the temporal change of the power of a right side channel. In a similar manner, a graph 411 in FIG. 4B illustrates the temporal change of the power of a left side channel, and a graph 412 illustrates the temporal change of the power of a right side channel.

As illustrated in FIG. 4A, immediately after time $T_t$ at which a transient has occurred actually in the input audio signal, the power of the right side channel is smaller than the power of the left side channel. For this reason, the detection time $Tr_L$ of the transient of the left side channel is close to the transient generation time $T_t$. However, the detection time $Tr_R$ of the transient of the right side channel is later than the transient generation time $T_t$, and the detection time $Tr_L$ of the transient of the left side channel. This time difference is attributable to the fact that a value that is calculated on the basis of the section containing a plurality of sampling points, such as a moving accumulated value, is used to detect a transient. For this reason, if the transients of the left and right channels are caused by the same sound, the absolute value $\Delta_{TR}$ ($=|Tr_R-Tr_L|$) of the difference between the detection times of the transients of the left and right channels becomes a comparatively small value, such as a value smaller than or equal to the section. Furthermore, the power of the right side channel at the detection time $Tr_L$ of the transient of the left side channel, which is indicated by a circle mark 403, becomes greater than or equal to a threshold value $Th_p$ having a certain degree of magnitude. In such a case, the transient time correction unit 33 determines that the transient detected in each channel is caused by the same sound. Then, the transient time correction unit 33 makes corrections so that the transient detection time $Tr_R$ of the right side channel, whose detection time is late, coincides with the transient detection time $Tr_L$ of the left side channel. Therefore, the transient detection time $Tr_R'$ of the right side channel after correction is equal to the transient detection time $Tr_L$ of the left side channel.

On the other hand, as illustrated in FIG. 4B, when the transient of the left side channel and the transient of the right side channel are caused by different sounds, there is a case where the absolute value $\Delta_{TR}$ of the difference between the detection times of the transients of the left and right channels becomes comparatively large. Furthermore, at the time of the transient detection time $Tr_L$ of the left side channel, since no transient has occurred in the right side channel, the power of the right side channel is small. Accordingly, the transient time correction unit 33 does not correct the transient detection time when the absolute value $\Delta_{TR}$ of the difference between the detection times of the transients of the left and right channels is greater than a certain threshold value $Th_d$. Also, the transient time correction unit 33 does not correct the transient detection time when the power at the transient detection time of the other channel with respect to the channel in which the transient detection time is late is less than the certain threshold value $Th_p$.

Figure 5:
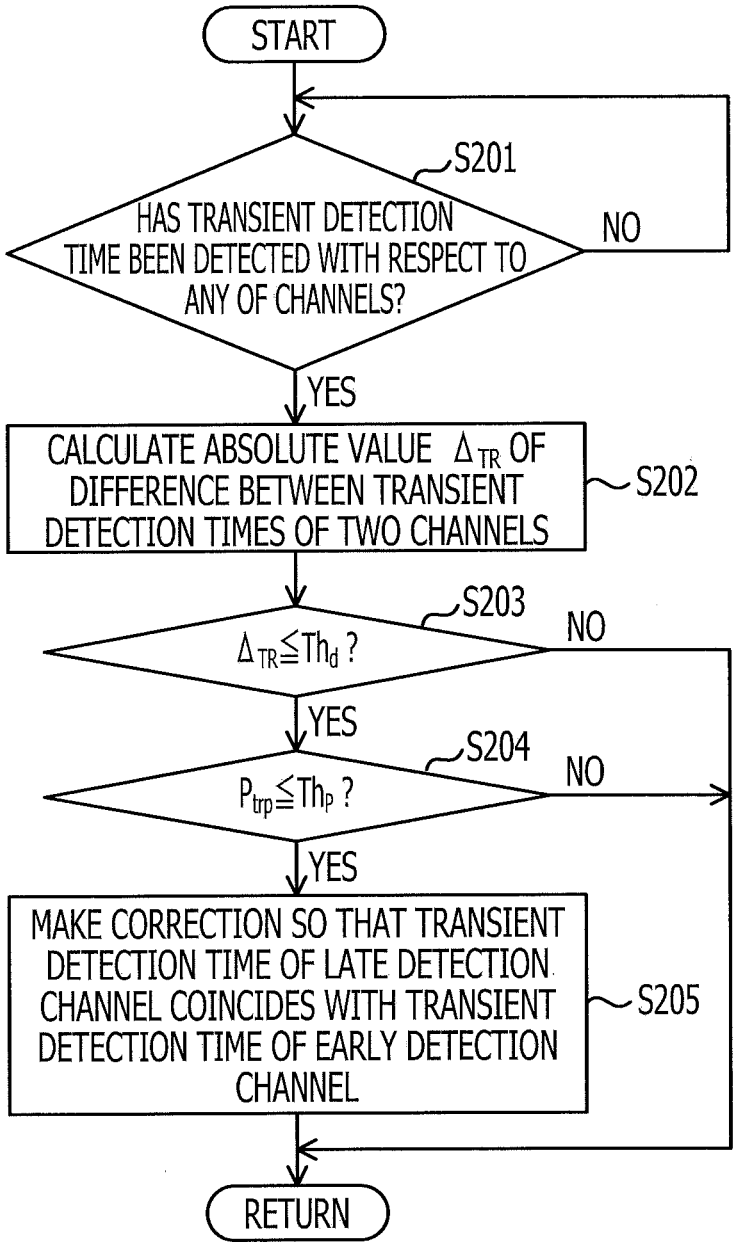
FIG. 5 is an operation flowchart of a transient detection time correction process.

FIG. 5 is an operation flowchart of a transient detection time correction process performed by the transient time correction unit 33.

The transient time correction unit 33 determines whether or not notification of the transient detection time has been given with respect to any of the channels from the transient detection unit 32 (operation S201). If notification of the transient detection time has not been given (operation S201—No), the transient time correction unit 33 repeats the process of operation S201.

On the other hand, when notification of a transient detection time is given with respect to any of the channels (operation S201—Yes), the transient time correction unit 33 temporarily stores the transient detection time and the channel in a memory included in the transient time correction unit 33. If the transient detection time of the other channel has been stored in the memory, the transient time correction unit 33 calculates the absolute value $\Delta_{TR}$ of the difference between the transient detection times of the two channels (operation S202). For the sake of convenience, the channel in which the transient detection time has been notified in operation S201 will be referred to as a late detection channel, and the channel in which a transient has been detected earlier than the transient detection time of the late detection channel will be referred to as an early detection channel. Then, the transient time correction unit 33 determines whether or not the absolute value $\Delta_{TR}$ of the difference is smaller than or equal to the certain threshold value $Th_d$ (operation S203). The threshold value $Th_d$ is set to, for example, the maximum value of the difference between the transient detection times for each channel, the transient being caused by the same sound. For example, when the transient detection unit 32 has calculated the moving accumulated value of the powers on the basis of a section containing three consecutive sampling points, the threshold value $Th_d$ is set to a value corresponding to the time length of the section.

When the absolute value $\Delta_{TR}$ of the difference between the transient detection times of the two channels is greater than the certain threshold value $Th_d$ or when no transient has been detected in the other channel (operation S203—No), the transient time correction unit 33 does not correct the transient detection time. Then, the transient time correction unit 33 notifies the grid determination unit 34 of the transient detection time of each channel. Furthermore, the transient time correction unit 33 deletes, from the memory, the powers of the sampling points of respective channels, which are at the transient detection time of the early detection channel and earlier than the transient detection time of the early detection channel. After that, the transient time correction unit 33 ends the transient detection time correction process.

On the other hand, when the absolute value $\Delta_{TR}$ of the difference between the transient detection times is smaller than or equal to the certain threshold value $Th_d$ (operation S203—Yes), the transient time correction unit 33 determines whether or not the power $P_{trp}$ of the late detection channel at the transient detection time of the early detection channel is greater than the threshold value $Th_p$ (operation S204). The threshold value $Th_p$ is a value corresponding to the power of the transient sound, and is set to, for example, a value such that the threshold value Th for detecting a transient is divided by the number of sampling points contained in the section for which the moving accumulated value is to be calculated.

When the power $P_{trp}$ of the late detection channel at the transient detection time of the early detection channel is smaller than or equal to the threshold value $Th_p$ (operation S204—No), the transient time correction unit 33 does not correct the transient detection time. Then, the transient time correction unit 33 notifies the grid determination unit 34 of the transient detection time of each channel. Furthermore, the transient time correction unit 33 deletes, from the memory, the power of the sampling point of each channel at the transient detection time of the early detection channel and earlier than the transient detection time of the early detection channel. After that, the transient time correction unit 33 ends the transient detection time correction process.

On the other hand, when the power $P_{trp}$ of the late detection channel at the transient detection time of the early detection channel is greater than the threshold value $Th_p$ (operation S204—Yes), the transient time correction unit 33 makes a correction so that the transient detection time of the late detection channel coincides with the transient detection time of the early detection channel (operation S205). Then, the transient time correction unit 33 notifies the grid determination unit 34 of the transient detection time of each channel. Then, the transient time correction unit 33 deletes the transient detection times of the early detection channel and the late detection channel from the memory. Furthermore, the transient time correction unit 33 deletes the power of the sampling point of each channel at a time earlier than the transient detection time of the detection channel, which was notified in operation S101. After that, the transient time correction unit 33 ends the transient detection time correction process.

In the case that from when the transient detection time has been notified with respect to one of the channels, no transient detection time is notified with respect to the other channel even if the threshold value $Th_d$ has passed, the transient time correction unit 33 determines that a transient has occurred in only the one channel. Then, the transient time correction unit 33 notifies the grid determination unit 34 of the transient detection time of the one channel. Then, the transient time correction unit 33 deletes, from the memory, the power of the sampling point of each channel at and earlier than the transient detection time at which notification has been given with respect to the one channel.

The grid determination unit 34 determines, for each frame, a grid for the high-frequency components for which coding is performed by the SBR coder 13 and a grid for the low frequency components for which coding is performed by the AAC coder 12. In the present embodiment, the grids are set so that the period of the grid of the high-frequency components and the period of the grid of the low frequency components become the same as each other at any timing. The grid determination unit 34 sets the grid for a non-transient sound to the preset section in which no transient has been detected in the frame of interest. The time length of the grid for a non-transient sound is, for example, about 50 msec.

Furthermore, when a transient has been detected in the frame of interest, the grid determination unit 34 sets the transient detection time to the boundary between two grids, which are consecutive along the time axis. Then, the grid determination unit 34 sets the grid for a transient sound, in which the transient detection time is set as a start time. The time length of the grid for a transient sound is shorter than the time length of the grid for a non-transient sound. For example, the grid determination unit 34 sets the time length of the grid for a transient sound to about 5 msec to about 20 msec. The grid immediately before the transient detection time differs depending on whether or not the transient has been detected earlier than the detection time. For example, if another transient has been detected within a certain period before the detection time of the transient of interest, the grid immediately before the detection time of the transient of interest also becomes a grid for a transient sound. The certain period is equal to, for example, the time length of the grid for a transient sound. On the other hand, if another transient has not been detected within the certain period immediately before the detection time of the transient of interest, the grid immediately before the detection time of the transient of interest becomes a grid for a non-transient sound.

The grid is set for each channel. However, when the transient detection time of any of the channels has been corrected by the transient time correction unit 33, the transient detection times of the left and right channels coincide with each other. As a consequence, the grid for a transient sound starts from the same transient detection time with respect to either channel.

Figure 6:
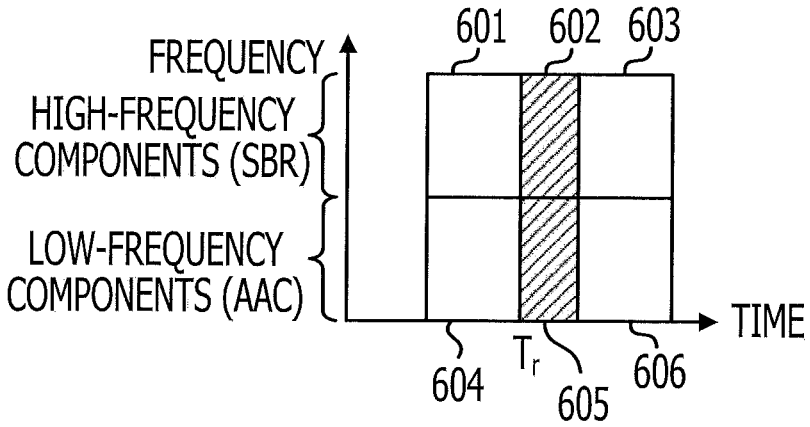
FIG. 6 illustrates an example of a grid.

FIG. 6 illustrates an example of a grid that is set with respect to one channel. In FIG. 6, the horizontal axis represents time, and the vertical axis represents a frequency. Time $t_r$ is a transient detection time. In this example, six grids 601 to 606 have been set. The grids 601 to 603 among them are grids that are set to high-frequency components that are coded by the SBR coder 13, and the grids 604 to 606 that are set to low frequency components that are coded by the AAC coder 12. The grids 601 and 604 are set in the same period. Similarly, the grids 602 and 605 are set in the same period, and the grids 603 and 606 are set in the same period. The grids 602 and 605 that are set in a period starting from the transient detection time $t_r$ are grids for a transient sound, and are set to a period shorter than that of the other grids, which are grids for a non-transient sound.

The grid determination unit 34 notifies the period of the grids for the high-frequency components and the low frequency components for each channel, and grid information indicating the start time to the grid power calculation unit 23, the auxiliary information calculation unit 25, and the multiplexing unit 27.

The grid power calculation unit 23 calculates the power for each grid with respect to each channel. For example, as illustrated in FIG. 6, when the entire frequency band is divided into two portions in the frequency direction, the grid power calculation unit 23 calculates the power for each grid in accordance with the following equations.

$$P_{gLl} = \sum_{k=0}^{fs-1} \sum_{n=t_{gs}}^{t_{ge}} |L(k, n)|^2 \tag{4}$$

$$P_{gLh} = \sum_{k=fs}^{63} \sum_{n=t_{gs}}^{t_{ge}} |L(k, n)|^2$$

-continued $$P_{gRl} = \sum_{k=0}^{fs-1} \sum_{n=t_{gs}}^{t_{ge}} |R(k, n)|^2$$

$$P_{gRh} = \sum_{k=fs}^{63} \sum_{n=t_{gs}}^{t_{ge}} |R(k, n)|^2$$

where L(k, n) is the time frequency signal of the n-th sampling point in the frequency band k of the left side channel, and R(k, n) is the time frequency signal of the n-th sampling point in the frequency band k of the right side channel. $t_{gs}$ and $t_{ge}$ are the first sampling point corresponding to the start time of the grid, and the last sampling point corresponding to the end time of the grid, respectively. fs is the sampling point in the frequency direction corresponding to the lowest frequency of the high-frequency components to be coded by the SBR coder 13. $P_{gLl}(n)$ and $P_{gLh}(n)$ are the powers of the low frequency components and the high-frequency components of the left side channel, respectively. Similarly, $P_{gRl}(n)$ and $P_{gRh}(n)$ are the powers of the low frequency components and the high-frequency components of the right side channel, respectively.

The grid power calculation unit 23 outputs the powers $P_{gLl}(n)$, $P_{gLh}(n)$, $P_{gRl}(n)$, and $P_{gRh}(n)$ for each grid with respect to each channel to the power quantization unit 24 and the auxiliary information calculation unit 25.

The power quantization unit 24 quantizes the powers $P_{gLl}(n)$ and $P_{gRl}(n)$ of the grids of the low frequency components, which are received from the grid power calculation unit 23 by using the, for example, a quantization coefficient that is determined according to the target code amount that is determined in accordance with a transmission bit rate. In the power quantization unit 24, for example, a quantization width that becomes wider as the quantization coefficient increases is set, and power for each grid is quantized at the quantization width. Then, the power quantization unit 24 outputs the quantized power for each grid to the multiplexing unit 27.

The auxiliary information calculation unit 25 calculates auxiliary information that is used to reproduce high-frequency components from the low frequency components on the basis of the powers of the grids of the low frequency components and the high-frequency components of each channel, and the time frequency signal. The auxiliary information contains, for example, with respect to each frequency band and each time period, which are contained in the grid of the high-frequency components, position information indicating the frequency band and the time period of the low frequency components from which reproduction is made, and an electric power adjustment parameter for adjusting the electric power of the high-frequency components. In addition, the auxiliary information contains information indicating the frequency band and the time period in the high-frequency components that is difficult to be reproduced from the low frequency components, and information indicating the power of the frequency band and the time period.

As is disclosed in, for example, Japanese Laid-open Patent Publication No. 2008-224902, the auxiliary information calculation unit 25 calculates auxiliary information in accordance with the SBR coding method. For example, with respect to the grid of interest of the high-frequency components of each channel, the auxiliary information calculation unit 25 compares the time frequency signal of each frequency band and time period within the grid with the time frequency signal in the grid of the low frequency components, which is set in the same period as the period of the grid of interest. Then, on the basis of the comparison result, the auxiliary information calculation unit 25 determines the position information on the basis of the frequency band and the time period of the low frequency components that are strongly correlated to the frequency band and the time period of the high-frequency components. Furthermore, the auxiliary information calculation unit 25 obtains the frequency band and the time period that is difficult to be reproduced from the low frequency components. In addition, the auxiliary information calculation unit 25 obtains the ratio of the power of the grid of interest of the high-frequency components of each channel to the power of the grid of the low frequency components from which reproduction is made, and calculates the electric power adjustment parameter in accordance with the ratio.

The auxiliary information calculation unit 25 outputs the auxiliary information to the auxiliary information quantization unit 26.

The auxiliary information quantization unit 26 quantizes the auxiliary information by using the quantization coefficient that is determined according to the target code amount that is determined in accordance with the transmission bit rate. By setting, for example, the quantization width that becomes wider as the quantization coefficient increases, the auxiliary information quantization unit 26 quantizes the auxiliary information at the quantization width. Then, the auxiliary information quantization unit 26 outputs the quantized auxiliary information to the multiplexing unit 27.

The multiplexing unit 27 codes the grid information, the quantized power of each grid, and the quantized auxiliary information in accordance with a variable length coding method, such as arithmetic coding or Huffman coding. Then, the multiplexing unit 27 arranges those pieces of variable-length-coded information in accordance with a certain data output format so as to be multiplexed. This multiplexed data is referred to as SBR data. The certain data output format is, for example, an MPEG-4 ADTS (Audio Data Transport Stream) format which will be described later, and the information that is variable-length-coded in accordance with the arrangement of the SBR data, which is specified in MPEG-4 ADTS, is arranged. The multiplexing unit 27 outputs the SBR data to the bit stream generation unit 14.

The bit stream generation unit 14 multiplexes the AAC data received from the AAC coder 12 and the SBR data received from the SBR coder 13 by arranging them in accordance with a certain order. Then, the bit stream generation unit 14 outputs the bit stream that is generated as a result of the multiplexing.

Figure 7:
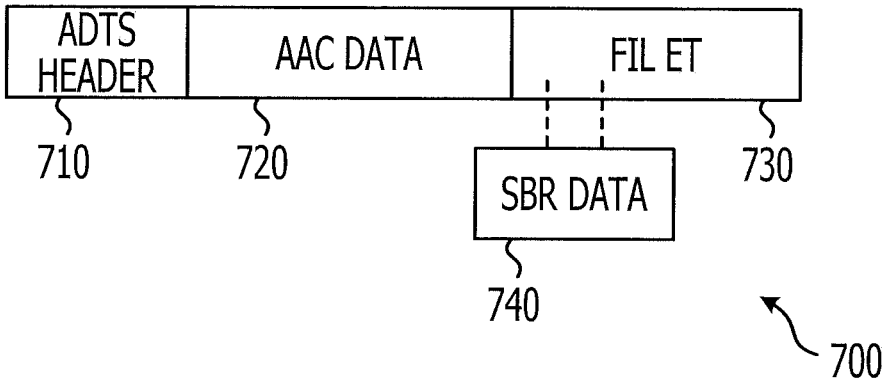
FIG. 7 illustrates an example of a data format in which a coded audio signal is stored.

FIG. 7 illustrates an example of a bit stream in which a coded audio signal has been stored. In this example, the bit stream is generated in accordance with the MPEG-4 ADTS format, and is output as HE-AAC data. A bit stream 700 illustrated in FIG. 7 includes a header block 710, an AAC data block 720, and a FIL element 730. Header information of an ADTS format is stored in the header block 710. AAC data is stored in the AAC data block 720. SBR data 740 is stored at a certain position in the FIL element 730.

Figure 8:
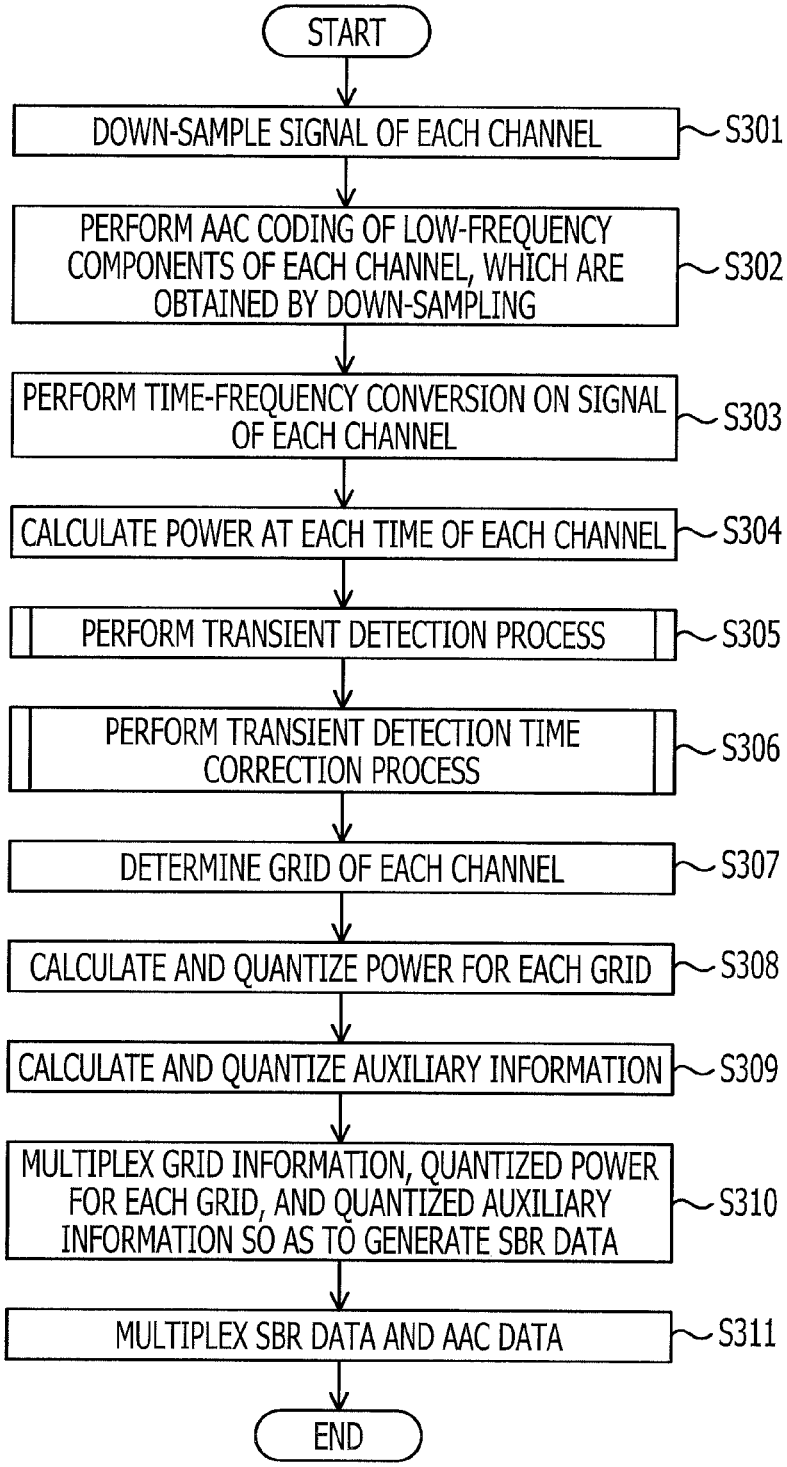
FIG. 8 is an operation flowchart of an audio coding process.

FIG. 8 is an operation flowchart of an audio coding process. The flowchart illustrated in FIG. 8 illustrates processing for an audio signal for one frame. The audio coding device 1 repeatedly performs the procedure of the audio coding process illustrated in FIG. 8 for each frame.

The down-sampling unit 11 extracts low frequency components by down-sampling the signal of each channel (operation S301). The down-sampling unit 11 outputs the low frequency components of each channel to the AAC coder 12. The AAC coder 12 codes the low frequency components of each channel in accordance with the AAC coding method (operation S302). Then, the AAC coder 12 outputs the AAC data obtained as a result of the coding to the bit stream generation unit 14.

Additionally, the signal of each channel of the audio signal is also input to the SBR coder 13. Then, the time frequency transform unit 21 of the SBR coder 13 performs a time frequency transform on the signal of the time domain of each channel (operation S303). The time frequency transform unit 21 outputs the time frequency signal of each channel, which is obtained as a result of the time frequency transform, to the grid generation unit 22, the grid power calculation unit 23, and the auxiliary information calculation unit 25.

The power calculation unit 31 of the grid generation unit 22 calculates power at each time with respect to each channel (operation S304). Then, the power calculation unit 31 outputs the power of each channel at each time to the transient detection unit 32 and the transient time correction unit 33 of the grid generation unit 22. The transient detection unit 32 performs a transient detection process for each channel (operation S305). When the transient detection unit 32 detects a transient, the transient detection unit 32 notifies the transient time correction unit 33 of the transient detection time.

The transient time correction unit 33 performs a transient detection time correction process (operation S306). When the transient time correction unit 33 has corrected the transient detection time with respect to any of the channels, the transient time correction unit 33 notifies the grid determination unit 34 of the grid generation unit 22 of the transient detection time after the correction. Furthermore, with respect to the channel in which the transient detection time has not been corrected, the transient time correction unit 33 notifies the grid determination unit 34 of the transient detection time that has been detected by the transient detection unit 32.

The grid determination unit 34 determines the grid of each channel (operation S307). In that case, the grid determination unit 34 sets a grid for a non-transient sound with respect to the section in which a transient has not been detected within the frame. On the other hand, if the transient has been detected, the grid determination unit 34 sets a grid for a transient sound, which is shorter than the grid for a non-transient sound, by using the transient detection time as a start time. The grid determination unit 34 notifies the grid information indicating the set grid to the grid power calculation unit 23, the auxiliary information calculation unit 25, and the multiplexing unit 27.

When the grid power calculation unit 23 is notified of the grid information, the grid power calculation unit 23 calculates power for each grid and quantizes the power for each grid (operation S308). Then, the power quantization unit 24 outputs the quantized power for each grid to the multiplexing unit 27. Furthermore, when the auxiliary information calculation unit 25 is notified of the grid information, the auxiliary information calculation unit 25 calculates the auxiliary information, and the auxiliary information quantization unit 26 quantizes the auxiliary information (operation S309). Then, the auxiliary information quantization unit 26 outputs the quantized auxiliary information to the multiplexing unit 27. The multiplexing unit 27 multiplexes the grid information, the quantized power for each grid, and the quantized auxiliary information so as to generate SBR data (operation S310). Then, the multiplexing unit 27 outputs the SBR data to the bit stream generation unit 14.

The bit stream generation unit 14 multiplexes the SBR data and the AAC data, and thereby generates a bit stream in which the coded audio data is stored (operation S311). After that, the audio coding device 1 ends the coding process.

The processing of operations S301 and S302 and the processing of operations S303 to S310 may be performed in parallel.

The audio signal that is coded by the audio coding device 1 may be reproduced by an audio decoding device corresponding to the SBR coding method, for example, an audio decoding device in compliance with MPEG-4 HE-AAC.

Figure 9A:
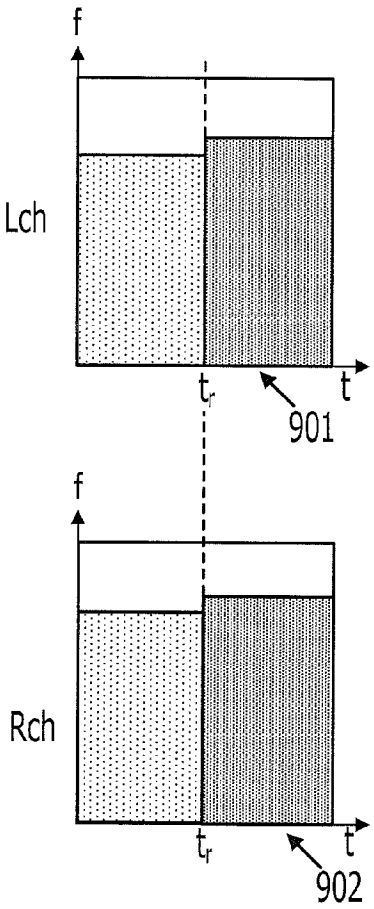
FIGS. 9A, 9B, 9C and 9D each illustrate a result of a comparison between an audio signal that is reproduced from an audio signal that is coded by the related art and an audio signal that is reproduced from an audio signal that is coded by an audio coding device according to the present embodiment.
Figure 9B:
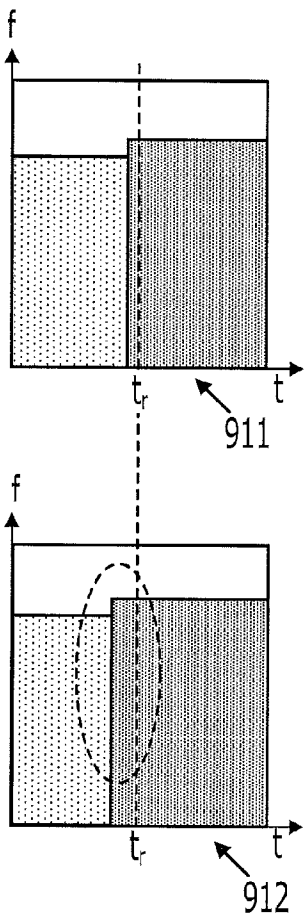
Figure 9C:
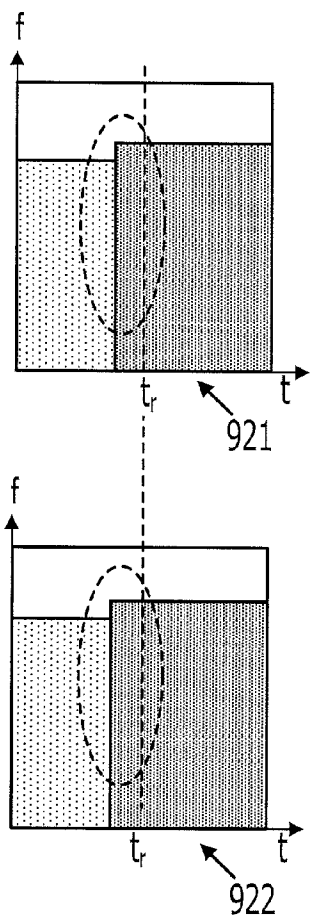
Figure 9D:
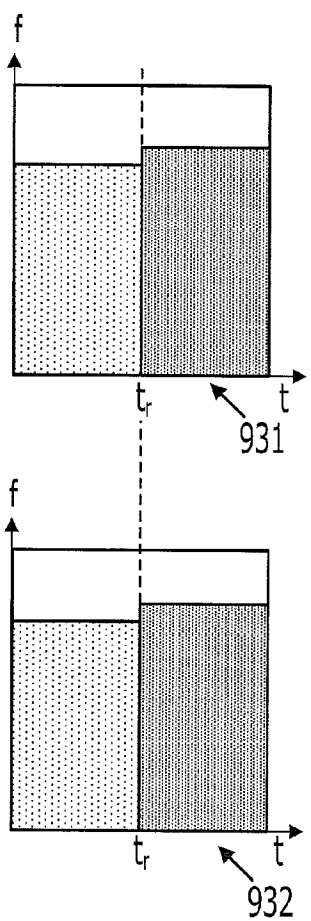

With reference to FIGS. 9A to 9D, a description will be given of pre-echo suppression effect in a stereo audio signal that has been coded by an audio coding device according to this embodiment. A graph 901 in the upper side of FIG. 9A illustrates time of the left side channel of an audio signal before being coded, and a signal intensity for each frequency. A graph 902 in the lower side thereof illustrate time of the right side channel of an audio signal before being coded, and a signal intensity for each frequency. A graph 911 in the upper side of FIG. 9B and a graph 912 in the lower side thereof illustrate signal intensities of the left side and the right side channel, in which after the audio signal illustrated in FIG. 9A is coded in accordance with the method disclosed in Japanese Unexamined Patent Application Publication (Translation of PCT Application) No. 2003-529787, the coded signal is reproduced. Similarly, a graph 921 in the upper side of FIG. 9C and a graph 922 in the lower side thereof illustrate the signal intensity of the left side channel and the right side channel in which after the audio signal illustrated in FIG. 9A is coded in accordance with a method disclosed in Japanese Laid-open Patent Publication No. 2006-3580, the coded signal is reproduced, respectively. A graph 931 in the upper side of FIG. 9D and a graph 932 in the lower side thereof illustrate the signal intensity of the left side channel and the right side channel in which after the audio signal illustrated in FIG. 9A is coded by the audio coding device 1, the coded signal is reproduced, respectively. In FIGS. 9A to 9D, the horizontal axis represents time, and the vertical axis represents a frequency. The density of each point represents a signal intensity at a time and frequency corresponding to that point; the darker the density, the stronger the signal intensity is.

As illustrated in the graphs 901 and 902, at time $t_r$, transients, which are caused by the same sound, have occurred in both the left side channel and the right side channel. In comparison, in the reproduction signal of the audio signal that has been coded by the method disclosed in Japanese National Publication of International Patent Application No. 2003-529787, in the right side channel, the signal intensity in the time-frequency domain 913 before time $t_r$ is stronger than the original sound. That is, a pre-echo has occurred in the time-frequency domain 913. Furthermore, in the reproduction signal of the audio signal that has been coded by the method disclosed in Japanese Laid-open Patent Publication No. 2006-3580, in the left side channel and the right side channel, the signal intensity in the time-frequency domains 923 and 924 before time $t_r$ is stronger than that of the original sound. That is, a pre-echo has occurred in the time-frequency domains 923 and 924. As described above, in the audio coding method of the related art, a pre-echo occurs, and as a result, reproduction sound quality deteriorates.

In comparison, in the reproduction signal of the audio signal that has been coded by the audio coding device 1, it may be seen that the signal intensity of each frequency immediately before time $t_r$ is almost equal to the signal intensity of each frequency immediately before time $t_r$ in the original sound, and a pre-echo has not occurred.

As has been described in the foregoing, when the detection time of the transient for each channel is different, the audio coding device determines whether or not the transient of each channel is caused by the same sound. When the audio coding device determines that the transient of each channel is caused by the same sound, the audio coding device makes a correction so that the transient detection time of the late detection channel coincides with the transient detection time of the early detection channel. As a consequence, it is possible for the audio coding device to set a grid for a transient sound by using a transient that has been detected at the earliest time as a reference with respect to each channel. Thus, it is possible to suppress a pre-echo from occurring in a channel in which the detection time is late. As a result, it is possible for the audio coding device to improve reproduction sound quality.

The present invention is not limited to the above-described embodiment. According to a modification, the transient time correction unit may determine whether or not the transient detection time of the late detection channel may be corrected on the basis of the difference between detection times of transients between channels regardless of the power of the late detection channel. For example, if the absolute value of the difference between transient detection times between channels is less than a certain time period, the transient time correction unit may make a correction so that the transient detection time of the late detection channel coincides with the transient detection time of the early detection channel. This certain time period is the maximum value of the difference between the transient detection times, in which the transient of each channel may be regarded as being caused by the same sound, and is set to, for example, the threshold value $Th_d$ in the above-described embodiment.

According to another modification, the transient time correction unit may determine the threshold value $Th_p$ in operation S204 in the operation flowchart of the transient detection time correction process illustrated in FIG. 5 on the basis of the power in the transient detection time of the early detection channel. In this case, the threshold value $Th_p$ is set to, for example, ¼ to ½ of the power at the transient detection time of the early detection channel.

Alternatively, in operation S204, the transient time correction unit may compare the powers in the transient detection times of each channel with each other instead of comparing the power of the late detection channel at the transient detection time of the early detection channel with the threshold value $Th_p$. In this case, if, for example, the ratio of the power at the transient detection time of the late detection channel to that at the transient detection time of the early detection channel is greater than ¼ to ½, it is sufficient that the transient time correction unit corrects the transient detection time of the late detection channel.

According to these modifications, it is possible for the transient time correction unit to correct the transient detection time by comparing the powers of both the channels with each other. Consequently, it is possible to accurately determine whether or not the difference in the transient detection times between the channels has been caused by the same sound.

The audio signal to be coded is not limited to a stereo audio signal, and may be an audio signal having a plurality of channels. For example, the audio signal to be coded may be made to be a 3.1 ch or 5.1 ch audio signal. When the number of channels of the audio signal to be coded is 3 or more, the audio coding device obtains the earliest time among the transient detection times of each channel. Then, the audio coding device may perform the transient detection time correction process between the channel corresponding to the earliest transient detection time and the other channels.

A computer program for causing a computer to realize the functions of each unit included in the audio coding device according to the embodiment or the modification may be provided in such a manner as to be stored on a recording medium, such as a semiconductor memory, a magnetic recording medium, or an optical recording medium.

Furthermore, the audio coding device according to the above-described embodiment or modification is mounted in various devices, such as a computer, a video signal recorder, and a video transmission device, which are used to transmit or record an audio signal.

Figure 10:
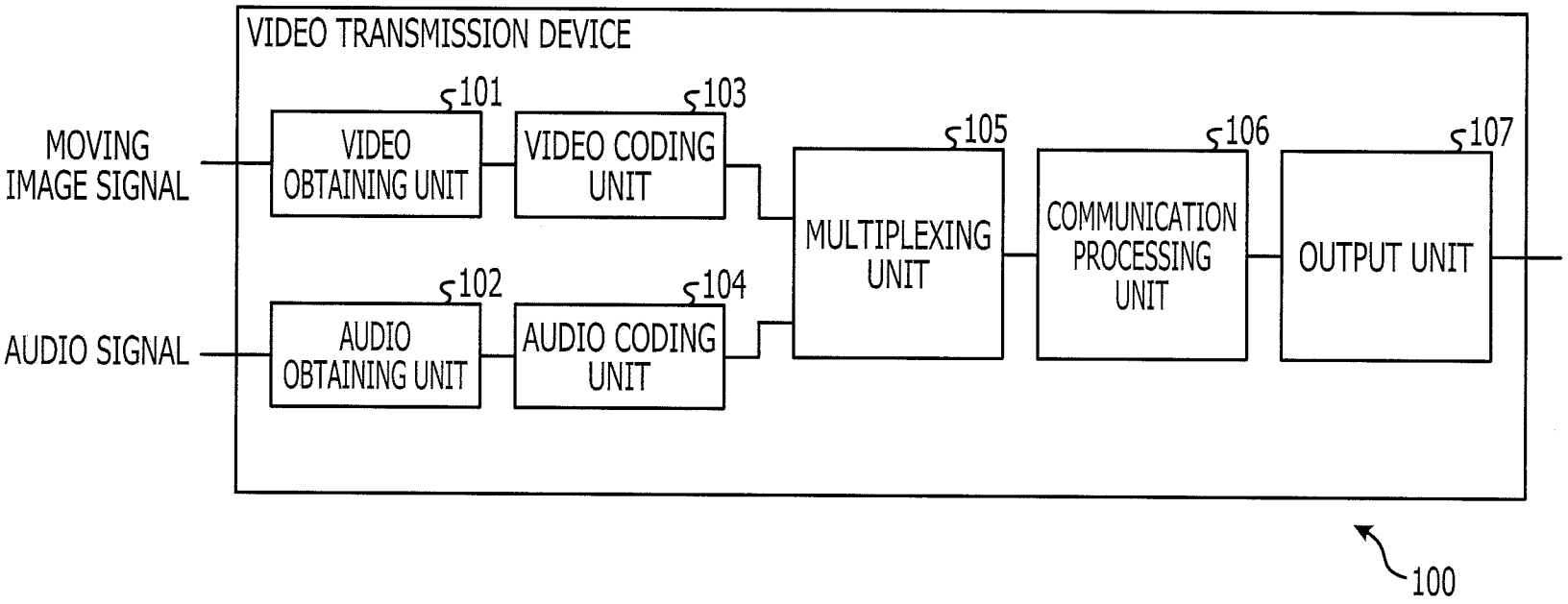
FIG. 10 is a schematic block diagram of a video transmission device into which an audio coding device that is disclosed in the present specification is incorporated.

FIG. 10 is a schematic block diagram of a video transmission device into which the audio coding device according to the embodiment or modification is incorporated. A video transmission device 100 includes a video obtaining unit 101, an audio obtaining unit 102, a video coding unit 103, an audio coding unit 104, a multiplexing unit 105, a communication processing unit 106, and an output unit 107.

The video obtaining unit 101 includes an interface circuit through which a moving image signal is obtained from another device, such as a video camera. Then, the video obtaining unit 101 passes the moving image signal that has been input to the video transmission device 100 to the video coding unit 103.

The audio obtaining unit 102 includes an interface circuit through which an audio signal is obtained from another device, such as a microphone. Then, the audio obtaining unit 102 passes the audio signal that has been input to the video transmission device 100 to the audio coding unit 104.

The video coding unit 103 codes the moving image signal in order to compress the amount of data of the moving image signal. For this purpose, the video coding unit 103 codes a moving image signal in accordance with a moving image coding standard, such as, for example, MPEG-2, MPEG-4, or H.264 MPEG-4 Advanced Video Coding (H.264 MPEG-4 AVC). Then, the video coding unit 103 outputs the coded moving image data to the multiplexing unit 105.

The audio coding unit 104 includes the audio coding device according to the above-described embodiment or the modification thereof. The audio coding unit 104 codes the audio signal in accordance with the embodiment or the modification thereof described above. Then, the audio coding unit 104 outputs the coded audio data to the multiplexing unit 105.

The multiplexing unit 105 multiplexes the coded moving image data and the coded audio data. Then, the multiplexing unit 105 generates a stream in compliance with a certain format for the transmission of video data, such as an MPEG-2 transport stream.

The multiplexing unit 105 outputs the stream in which the coded moving image data and the coded audio data have been multiplexed to the communication processing unit 106.

The communication processing unit 106 divides the stream in which the coded moving image data and the coded audio data have been multiplexed into packets in compliance with a certain communication standard, such as TCP/IP. Furthermore, the communication processing unit 106 attaches a certain header in which destination information or the like is stored to each packet. Then, the communication processing unit 106 passes the packets to the output unit 107.

The output unit 107 includes an interface circuit for connecting the video transmission device 100 to a communication line. Then, the output unit 107 outputs the packets received from the communication processing unit 106 to the communication line.

Figure 11:
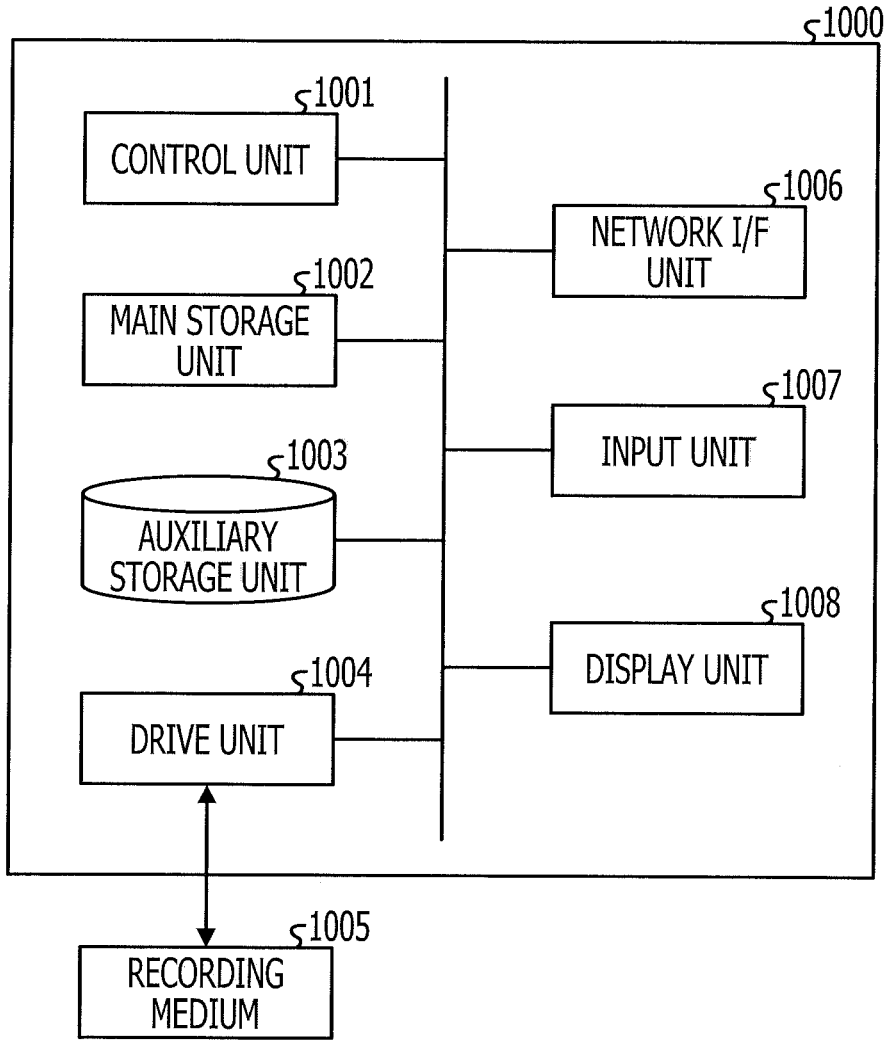
FIG. 11 illustrates an example of the configuration of an audio coding device disclosed in the present specification.

FIG. 11 illustrates an example of the configuration of an audio coding device 1000. As illustrated in FIG. 11, the audio coding device 1000 includes a control unit 1001, a main storage unit 1002, an auxiliary storage unit 1003, a drive device 1004, a network I/F unit 1006, an input unit 1007, and a display unit 1008. These components are interconnected with one another through a bus.

The control unit 1001 is a CPU in a computer, which performs control of each device, and computations and processing of data. The control unit 1001 is also an arithmetic operation device that executes a program stored in the main storage unit 1002 or the auxiliary storage unit 1003. After the control unit 1001 receives data from the input unit 1007 or the storage device, the control unit 1001 performs computations and processing thereof, and outputs the results to the display unit 1008, the storage device, and the like.

The main storage unit 1002 is formed of a read only memory (ROM), a random access memory (RAM), or the like. The main storage unit 1002 is a storage device for temporarily storing programs, such as an OS that is basic software, and application software, which are executed by the control unit 1001, and data.

The auxiliary storage unit 1003 is a hard disk drive (HDD) or the like, and is a storage device for storing data associated with application software or the like.

The drive device 1004 reads a program from the recording medium 1005, for example, a flexible disk, and installs the program in the storage device.

Furthermore, a certain program is stored on the recording medium 1005. The program stored on the recording medium 1005 is installed into the audio coding device 1000 through the drive device 1004. The installed certain program becomes executable by the audio coding device 1000.

The network I/F unit 1006 is an interface between peripheral devices and the audio coding device 1000 having a communication function, which are connected through a network, such as a local area network (LAN) or a wide area network (WAN), which is constructed of data transmission paths, such as a wired line and/or a wireless line.

The input unit 1007 includes a keyboard having cursor keys, numeral input keys, and various function keys, and the like, a mouse for making a selection of keys, a slice putt or the like on the display screen of the display unit 1008. Furthermore, the input unit 1007 is a user interface through which a user gives an operation instruction to the control unit 1001 and inputs data.

The display unit 1008 is constituted by a cathode ray tube (CRT), a liquid crystal display (LCD), or the like, and performs display corresponding to display data input from the control unit 1001.

As described above, the audio coding process described in the embodiment described above may be implemented as a program to be executed by a computer. By installing this program from a server or the like and causing a computer to execute the program, the audio coding process described above may be realized.

Furthermore, this program may be recorded on the recording medium 1005, and the recording medium 1005 having the program recorded thereon is read by a computer and a mobile terminal, so that the audio coding process described above may be realized. Various types of recording media may be used for the recording medium 1005. Examples thereof include a recording medium on which information is optically, electrically, or magnetically recorded, like a CD-ROM, a flexible disk, or a magneto-optical disc, a ROM, a semiconductor memory in which information is electrically recorded like a flash memory, or the like. Furthermore, the audio coding process described in each of the above-described embodiments may be mounted on one or more integrated circuits.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An audio coding device comprising:

a time frequency transform unit that, with respect to each of a plurality of channels included in an audio signal, generates a time frequency signal indicating frequency components at each time by performing a time frequency transform on a signal of the channel;

a transient detection unit that detects a transient with respect to each of the plurality of channels so as to obtain a transient detection time;

a transient time correction unit that, when a difference in transient detection times between an early detection channel in which the transient detection time is earliest and a late detection channel that is a channel other than the early detection channel among the plurality of channels is within a range in which the transient being regarded as a transient caused by the same sound, makes a correction so that the transient detection time of the late detection channel coincides with the transient detection time of the early detection channel;

a grid determination unit that, with respect to each of the plurality of channels, sets a grid for a non-transient sound in a section in which the transient has not been detected, and sets a grid for a transient sound having a length of time shorter than that of the grid for a non-transient sound in a section in which the transient has been detected; and a coding unit that codes the audio signal for each grid for a transient sound or for each grid for a non-transient sound.

2. The device according to claim 1, further comprising:

a power calculation unit that calculates power at each time on the basis of the time frequency signal with respect to each of the plurality of channels, wherein the transient detection unit sets, with respect to each of the plurality of channels, a certain section containing a plurality of times, obtains a statistical value of the powers at times within the certain section while moving the certain section along the time axis, detects the transient with respect to the channel when the statistical value exceeds a first threshold value, and sets any of the times included in the certain section as the transient detection time.

3. The device according to claim 2, wherein when the difference between the transient detection time of the early detection channel and the transient detection time of the late detection channel is shorter than the certain section, the transient time correction unit determines that the difference between the transient detection times is in a range in which the transient being regarded as a transient caused by the same sound.

4. The device according to claim 1, wherein the transient time correction unit makes a correction so that the transient detection time of the late detection channel coincides with the transient detection time of the early detection channel only when the power of the late detection channel at the transient detection time of the early detection channel is greater than a second threshold value corresponding to the power of the transient sound.

5. The device according to claim 1, wherein the transient time correction unit makes a correction so that the transient detection time of the late detection channel coincides with the transient detection time of the early detection channel only when a ratio of the power at the transient detection time of the late detection channel to the power at the transient detection time of the early detection channel is greater than a certain value.

6. The device according to claim 1, further comprising:

a down-sampling unit that extracts low frequency components having a frequency lower than a first frequency from a signal of each of the plurality of channels; and a low frequency coding unit that codes the low frequency components in accordance with a certain coding method, wherein the grid determination unit individually sets the grid for a non-transient sound or the grid for a transient sound so that the same period is reached with respect to the low frequency components, and high-frequency components having a frequency higher than or equal to the first frequency, with respect to each of the plurality of channels, and wherein the coding unit obtains auxiliary information that is used to reproduce the time frequency signal within the grid of the low frequency components as the corresponding high-frequency components, the grid being set in the same period, and codes the auxiliary information and the power of the grid of the low frequency components.

7. An audio coding method comprising:

generating, with respect to each of a plurality of channels included in an audio signal, a time frequency signal indicating frequency components at each time by performing a time frequency transform on a signal of the channel;

detecting a transient with respect to each of the plurality of channels so as to obtain a transient detection time;

making, by a processor, when a difference in transient detection times between an early detection channel in which the transient detection time is earliest and a late detection channel that is a channel other than the early detection channel among the plurality of channels is within a range in which the transient being regarded as a transient caused by the same sound, a correction so that the transient detection time of the late detection channel coincides with the transient detection time of the early detection channel;

setting a grid for a non-transient sound in a section in which the transient has not been detected, and setting a grid for a transient sound of a length of time shorter than that of the grid for a non-transient sound in a section in which the transient has been detected with respect to each of the plurality of channels; and coding the audio signal for each grid for a transient sound or for each grid for a non-transient sound.

8. The method according to claim 7, further comprising:

calculating power at each time based on the time frequency signal with respect to each of the plurality of channels, wherein in the detecting and obtaining of the transient time, a certain section containing a plurality of times with respect to each of the plurality of channels is set, a statistical value of powers at times within the certain section containing the plurality of times is obtained while moving the certain section along the time axis, the transient is detected with respect to the channel when the statistical value exceeds a first threshold value, and any of the times included in the certain section is detected as the transient detection time.

9. The method according to claim 8, wherein in the making of a correction, it is determined that when a difference between the transient detection time of the early detection channel and the transient detection time of the late detection channel is shorter than the certain section, a difference between the detection times is within a range in which the transient being regarded as a transient caused by the same sound.

10. The method according to claim 7, wherein in the making of a correction, only when the power of the late detection channel at the transient detection time of the early detection channel is greater than a second threshold value corresponding to the power of the transient sound, the transient detection time of the late detection channel is corrected so as to coincide with the transient detection time of the early detection channel.

11. The method according to claim 7, wherein in the making of a correction, the transient detection time of the late detection channel is corrected so as to coincide with the transient detection time of the early detection channel only when a ratio of the power at the transient detection time of the late detection channel to the power at the transient detection time of the early detection channel is greater than a certain value.

12. The method according to claim 7, further comprising:

extracting low-frequency components having a frequency lower than a first frequency from a signal of each of the plurality of channels, and down-sampling the low-frequency components; and coding the low-frequency components in accordance with a certain coding method, wherein in the setting of the grid, the grid for a non-transient sound or the grid for a transient sound is individually set so that the same period is reached with respect to the low frequency components, and high-frequency components having a frequency higher than or equal to the first frequency, with respect to each of the plurality of channels, and wherein in the coding, auxiliary information that is used to reproduce the time frequency signal within the grid of the low frequency components as the corresponding high-frequency components, the grid being set in the same period, is obtained, and the auxiliary information and the power of the grid of the low frequency components are coded.

13. A non-transitory computer-readable storage medium storing an audio coding computer program that causes a computer to execute processing comprising:

generating, with respect to each of a plurality of channels included in an audio signal, a time frequency signal indicating frequency components at each time by performing a time frequency transform on a signal of the channel;

detecting a transient with respect to each of the plurality of channels so as to obtain a transient detection time;

making, when a difference in transient detection times between an early detection channel in which the transient detection time is earliest and a late detection channel that is a channel other than the early detection channel among the plurality of channels is within a range in which the transient being regarded as a transient caused by the same sound, a correction so that the transient detection time of the late detection channel coincides with the transient detection time of the early detection channel;

setting a grid for a non-transient sound in a section in which the transient has not been detected, and setting a grid for a transient sound of a length of time shorter than that of the grid for a non-transient sound in a section in which the transient has been detected with respect to each of the plurality of channels; and coding the audio signal for each grid for a transient sound or for each grid for a non-transient sound.

14. The non-transitory computer-readable storage medium according to claim 13, further comprising:

calculating power at each time based on the time frequency signal with respect to each of the plurality of channels, wherein in the detecting and obtaining of the transient time, a certain section containing a plurality of times with respect to each of the plurality of channels is set, a statistical value of powers at times within the certain section containing the plurality of times is obtained while moving the certain section along the time axis, the transient is detected with respect to the channel when the statistical value exceeds a first threshold value, and any of the times included in the certain section is detected as the transient detection time.

15. The non-transitory computer-readable storage medium according to claim 14, wherein in the making of a correction, it is determined that when a difference between the transient detection time of the early detection channel and the transient detection time of the late detection channel is shorter than the certain section, a difference between the detection times is within a range in which the transient being regarded as a transient caused by the same sound.

16. The non-transitory computer-readable storage medium according to claim 13, wherein in the making of a correction, only when the power of the late detection channel at the transient detection time of the early detection channel is greater than a second threshold value corresponding to the power of the transient sound, the transient detection time of the late detection channel is corrected so as to coincide with the transient detection time of the early detection channel.

17. The non-transitory computer-readable storage medium according to claim 13, wherein in the making of a correction, the transient detection time of the late detection channel is corrected so as to coincide with the transient detection time of the early detection channel only when a ratio of the power at the transient detection time of the late detection channel to the power at the transient detection time of the early detection channel is greater than a certain value.

18. The non-transitory computer-readable storage medium according to claim 13, further comprising:

extracting low-frequency components having a frequency lower than a first frequency from a signal of each of the plurality of channels, and down-sampling the low-frequency components; and coding the low-frequency components in accordance with a certain coding method, wherein in the setting of the grid, the grid for a non-transient sound or the grid for a transient sound is individually set so that the same period is reached with respect to the low frequency components, and high-frequency components having a frequency higher than or equal to the first frequency, with respect to each of the plurality of channels, and wherein in the coding, auxiliary information that is used to reproduce the time frequency signal within the grid of the low frequency components as the corresponding high-frequency components, the grid being set in the same period, is obtained, and the auxiliary information and the power of the grid of the low frequency components are coded.

* * * * *